US006860968B1

(12) United States Patent
Chuang et al.

(10) Patent No.: US 6,860,968 B1
(45) Date of Patent: Mar. 1, 2005

(54) TISSUE IMPULSE DRYING

(75) Inventors: Strong Chuang, Appleton, WI (US); Ken Kaufman, Alpharetta, GA (US); Jay Hsu, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/577,461

(22) Filed: May 24, 2000

(51) Int. Cl.[7] ..... D21F 11/14

(52) U.S. Cl. ..... 162/206; 162/205; 162/109; 34/400; 34/444

(58) Field of Search ..... 162/109, 117, 162/204–207, 111–113; 34/397–400, 423–426, 419, 442, 444, 446

(56) References Cited

U.S. PATENT DOCUMENTS

| | | | | |
|---|---|---|---|---|
| 3,198,695 | A | | 8/1965 | Justus |
| 3,691,010 | A | | 9/1972 | Krake |
| 3,905,863 | A | | 9/1975 | Ayers |
| 4,139,410 | A | | 2/1979 | Tapio et al. |
| 4,302,282 | A | | 11/1981 | Young |
| 4,324,613 | A | | 4/1982 | Wahren |
| 4,485,567 | A | | 12/1984 | Ely |
| 4,510,698 | A | | 4/1985 | Ely |
| 4,533,437 | A | | 8/1985 | Curran et al. |
| 4,911,791 | A | | 3/1990 | Mokvist |
| 5,092,962 | A | | 3/1992 | Koski |
| 5,120,400 | A | | 6/1992 | Laapotti |
| 5,127,168 | A | | 7/1992 | Pikulik |
| 5,164,047 | A | | 11/1992 | Koski |
| 5,385,644 | A | | 1/1995 | Hannus et al. |
| 5,556,511 | A | | 9/1996 | Bluhm et al. |
| 5,598,643 | A | | 2/1997 | Chuang et al. |
| 5,669,159 | A | | 9/1997 | Orloff et al. |
| 5,699,626 | A | | 12/1997 | Chuang et al. |
| 5,701,682 | A | | 12/1997 | Chuang et al. |
| 5,766,422 | A | | 6/1998 | Crouse |
| 5,785,813 | A | | 7/1998 | Smith et al. |
| 5,839,203 | A | | 11/1998 | Orloff et al. |
| 5,921,000 | A | | 7/1999 | Wedel et al. |
| 6,033,523 | A | | 3/2000 | Dwiggins et al. |
| 6,083,346 | A | | 7/2000 | Hermans et al. |
| 6,187,139 | B1 | * | 2/2001 | Edwards et al. ..... 162/111 |
| 6,248,210 | B1 | * | 6/2001 | Edwards et al. ..... 162/111 |
| 6,344,110 | B1 | * | 2/2002 | Reiner et al. ..... 162/109 |
| 6,379,496 | B2 | * | 4/2002 | Edwards et al. ..... 162/111 |
| 6,432,267 | B1 | * | 8/2002 | Watson ..... 162/111 |
| 6,444,089 | B1 | * | 9/2002 | Hollmark et al. ..... 162/109 |
| 6,454,904 | B1 | * | 9/2002 | Hermans et al. ..... 162/205 |
| 6,454,905 | B1 | * | 9/2002 | Hollmark et al. ..... 162/206 |
| 6,488,816 | B1 | * | 12/2002 | Klerelid ..... 162/359.1 |
| 6,503,370 | B2 | * | 1/2003 | Hollmark et al. ..... 162/117 |
| 6,511,579 | B1 | * | 1/2003 | Edwards et al. ..... 162/111 |
| 6,579,418 | B2 | * | 6/2003 | Lindsay et al. ..... 162/198 |
| 6,585,861 | B2 | * | 7/2003 | Odhe et al. ..... 162/280 |
| 6,596,127 | B2 | * | 7/2003 | Hollmark et al. ..... 162/206 |
| 6,613,194 | B2 | * | 9/2003 | Kanitz et al. ..... 162/280 |

FOREIGN PATENT DOCUMENTS

| | | |
|---|---|---|
| WO | WO 9323615 | 11/1993 |
| WO | WO 9947749 | 9/1999 |
| WO | WO 9949131 | 9/1999 |
| WO | WO 0020683 | 4/2000 |
| WO | WO 0020685 | 4/2000 |
| WO | WO 0029667 | 5/2000 |

OTHER PUBLICATIONS

PCT International Search Report dated Oct. 18, 2001.

* cited by examiner

*Primary Examiner*—José A. Fortuna
(74) *Attorney, Agent, or Firm*—Dority & Manning, P.A.

(57) ABSTRACT

A process for producing tissue webs is disclosed. More particularly, the present invention is directed to an improved process for drying webs. According to the present invention, a formed web still containing a substantial amount of moisture is passed through a nip formed between a press roll and a heated drum. When passed through the nip, the web is placed on a porous fabric. The web is then carried through the nip for a period of time and subjected to temperatures and pressures sufficient to create a steam front which travels through the web and expels a significant amount of moisture from the web through the porous fabric.

33 Claims, 1 Drawing Sheet

TISSUE IMPULSE DRYING

BACKGROUND OF THE INVENTION

Products made from nonwoven webs such as bath tissues and facial tissues are designed to include several important properties. For example, the products should have a soft feel and, for most applications, should be moisture absorbent. The products should also have adequate stretch characteristics and should resist tearing. Further, the products should also have good strength characteristics, and should not deteriorate in the environment in which they are used.

In the past, many attempts have been made to enhance and increase certain physical properties of such products. Unfortunately, however, when steps are taken to increase one property of these products, other characteristics of the products may be adversely affected. For instance, the softness of sanitary paper products, such as tissue webs, can be increased by several different methods, such as by selecting a particular fiber type, or by reducing cellulosic fiber bonding within the product. Increasing softness according to one of the above methods, however, may adversely affect the strength of the product. Conversely, steps normally taken to increase the strength of a tissue web typically have an adverse impact upon the softness, the stiffness or the absorbency of the web.

In order to increase the softness of tissue webs without adversely affecting other characteristics of the web, those of ordinary skill in the art have devised different methods for drying the webs after the webs have been formed. For instance, in one embodiment, tissue webs have been dried using a heated dryer drum. In this embodiment, the web is pressed into engagement with the surface of a dryer drum to which it adheres due to its moisture content and its preference for the smooth surface of the drum. As the web is carried through a portion of the rotational path of the dryer surface, heat is imparted to the web causing most of the moisture contained within the web to be evaporated. The web can then be removed from the dryer drum by a creping blade which reduces internal bonding within the web and increases softness.

In an alternative embodiment, instead of wet pressing the tissue web onto a dryer drum and creping the web, the web is through air dried. A through air dryer accomplishes the removal of moisture from the tissue web by passing hot air through the web without applying any mechanical pressure.

A need remains, however, for an improved method for drying tissue webs. In particular, pressing a web on a dryer drum as described above has a tendency to compress the web causing the web to lose bulk. This problem is not experienced using a through air dryer. Through air dryers, however, have high energy and capital requirements and are relatively expensive to operate.

The present invention is directed to improvements in sanitary paper webs and to improvements in processes for making the webs in a manner that optimizes the physical properties of the webs. In particular, the present invention is directed to an improved process for drying tissue webs that is relatively economical and that produces tissue webs having high bulk and good softness.

SUMMARY OF THE INVENTION

The present invention is generally directed to a process for producing sanitary paper webs, primarily tissue webs. The process includes the steps of forming a web from an aqueous suspension of fibers. The fibers contained in the aqueous suspension can be softwood fibers and/or hardwood fibers. The web is placed on a porous fabric. For instance, the porous fabric can cover up to about 50% of the surface area of the side of the web in contact with the fabric. More particularly, the porous fabric can cover up to about 30% of the surface area of the side of the web in contact with the fabric.

Once placed onto the porous fabric, the web is passed through a nip and onto a heated drum. The nip is formed between the heated drum and a press roll. While in the nip, the web is subjected to a temperature and to a pressure sufficient to expel at least 20% of the moisture contained in the web, and particularly at least 40% of the moisture contained in the web through the porous fabric. In this manner, the web is rapidly dried without losing a substantial amount of bulk in comparison to webs in contact with a felt. In particular, not only does the porous fabric allow moisture to escape from the web, but also compresses the fabric only in distinct areas.

The temperatures and pressures to which the web is subjected will depend upon the particular application. For most applications, however, the temperature of the heated drum should be at least 212° F. and particularly from about 220° F. to about 280° F. The pressure within the nip can be from about 100 psi to about 800 psi, and particularly from about 150 psi to about 600 psi. As used herein, the pressure within the nip is calculated by dividing the pressure per linear inch by the width of the nip. It should be understood that the pressure exerted on the web can be much greater in localized areas especially where the knuckles of the fabric are pressing against the web. For instance, localized areas of the web may be subjected to pressures greater than 1,000 psi.

In one aspect of the present invention, the inventors discovered that generally better results are obtained when the web has a longer residence time within the nip. In this regard, the residence time of the web in the nip should generally be at least 10 milliseconds. More particularly, residence time of the web in the nip can be at least 20 milliseconds, at least 30 milliseconds, and in some embodiments, at least 50 milliseconds.

When being passed through the nip, it has also been generally found that the wet web should have a solids content of at least 18%, particularly from about 18% to about 50%, and more particularly from about 28% to about 42%. As used herein, solids content is calculated by dividing the amount of fiber contained in the web by the sum of the amount of water contained in the web and the amount of fiber contained in the web.

In order to control the amount of moisture contained in the web, a moisture removal device can be positioned upstream from the nip along the porous fabric. The moisture removal device can be, for instance, an air press, a capillary dewatering device, and/or a vacuum box.

The process of the present invention is particularly well suited to processing tissue webs, such as facial tissues and bath tissues. For most applications, the basis weight of the moisture free web should be from about 6 pounds per ream to about 30 pounds per ream (2880 $ft^2$).

Other features and aspects of the present invention are discussed in greater detail below.

BRIEF DESCRIPTION OF THE DRAWING

A full and enabling disclosure of the present invention, including the best mode thereof to one of ordinary skill in the art, is set forth more particularly in the remainder of the specification, including reference to the accompanying figure in which.

Figure 1:
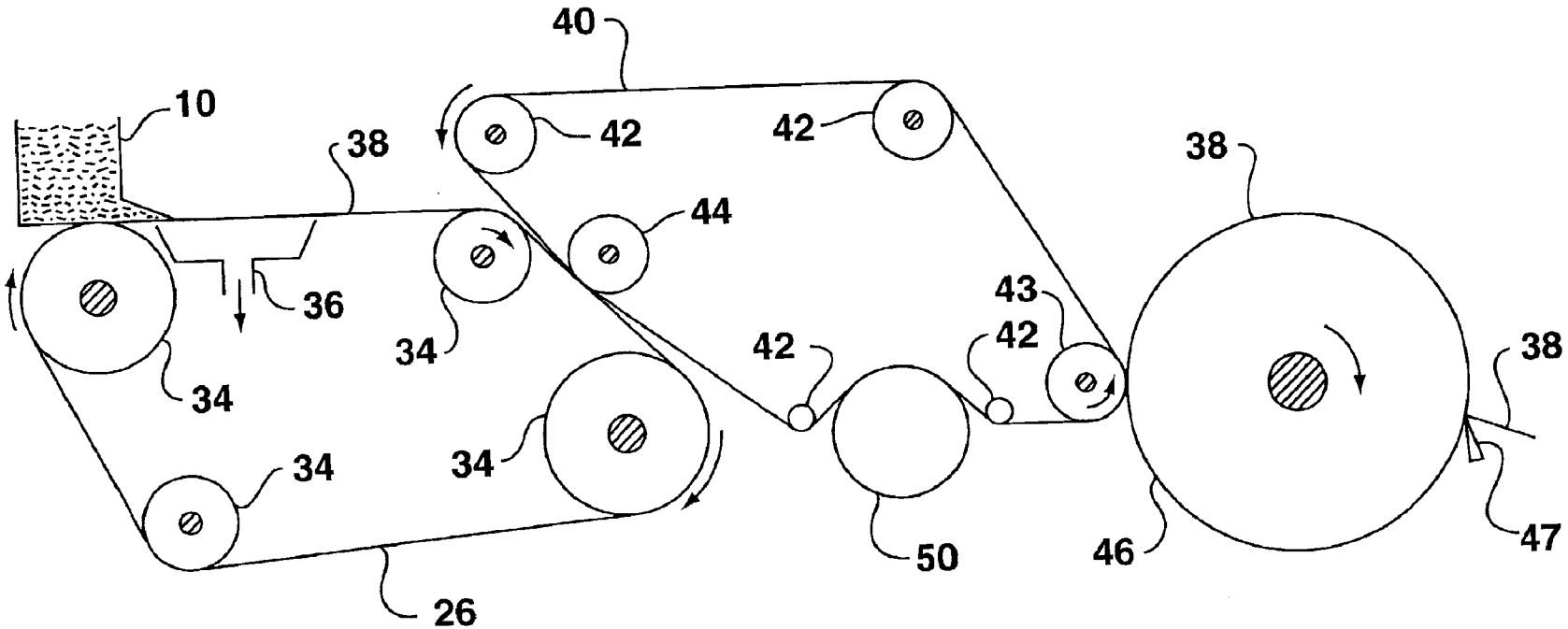
FIG. 1 illustrates one embodiment of a system and process made in accordance with the present invention for producing base webs.

Repeat use of reference characters in the present specification and drawings is intended to represent same or analogous features or elements of the present invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

In general, the present invention is directed to a process for producing sanitary paper webs, mainly tissue webs, such as facial tissues and bath tissues. More particularly, the present invention is directed to an improved process for drying tissue webs that is economical and produces webs having high bulk and good softness characteristics.

Generally speaking, the process of the present invention includes the step of passing a wet tissue web carried on a porous fabric through a nip formed by two rotating rolls. At least one of the rolls is heated. In accordance with the present invention, the tissue web is maintained in the nip for a residence time and is subjected to temperatures and pressures sufficient for a significant and unexpectedly high amount of water to be expelled out of the web.

The general principles of this drying phenomenon have been referred to in the past as impulse drying. For example, references that disclose drying processes that follow this general theory include U.S. Pat. No. 4,324,613, U.S. Pat. No. 5,669,159, and U.S. Pat. No. 5,839,203 which are all incorporated herein by reference. It is believed that when wet sheets are passed through a press nip under sufficient temperature and pressure a transient vapor front is generated on the hot roll surface pushing explosively through the wet sheets and thus expels a significant amount of free water.

The present invention is directed to an impulse drying process for lower basis weight webs (generally less than 30 lbs/ream), such as facial tissues and bath tissues. In accordance with the present invention, the lower basis weight web is placed on a porous fabric so as to minimize the amount of the web that is compressed during the process. For instance, the porous fabric can cover less than about 50% of the surface area of the side of the web contacting the fabric, and particularly can contact less than 30% of the surface area of the side of the web that is contacting the fabric.

The present inventors have also discovered that improved results are achieved when the tissue web is maintained in the nip for an extended length of time. For instance, for most applications, the web should remain in the nip for at least 10 milliseconds, particularly at least 20 milliseconds, and in some applications for at least 50 milliseconds.

Referring to FIG. 1, one embodiment of a process for producing a base web in accordance with the present invention is illustrated. As shown, the web forming system includes a headbox 10 for receiving an aqueous suspension of fibers. Headbox 10 spreads the aqueous suspension of fibers onto a forming fabric 26 that is supported and driven by a plurality of guide rolls 34. A vacuum box 36 is disposed beneath forming fabric 26 and is adapted to remove water from the fiber furnish to assist in forming a web.

As described above, in general, the present invention is directed to the formation of lower basis weight sheets, such as facial tissues and bath tissues. In general, the webs can have a basis weight of less than about 30 pounds per ream, and particularly from about 6 pounds per ream to about 30 pounds per ream. The web can be made from various fibers such as pulp fibers or a mixture of pulp fibers and synthetic or staple fibers. Pulp fibers typically used to form tissue webs include softwood fibers, such as Northern softwood kraft fibers and hardwood fibers, such eucalyptus fibers.

Further, the base web produced can be formed from a single homogeneous layer of fibers or can be formed from a stratified fiber furnish. For example, stratified base webs can be formed having two outer layers of fibers and a middle layer of fibers. The different layers can contain different types of fibers in different proportions.

As shown in FIG. 1, from forming fabric 26, a formed web 38 is transferred to a second fabric 40. Fabric 40 is supported for movement around a continuous path by a plurality of guide rolls 42. Also included is a pick-up roll or shoe 44 designed to facilitate transfer of web 38 from fabric 26 to fabric 40. The speed at which fabric 40 can be driven is approximately the same speed at which fabric 26 is driven so that movement of web 38 through the system is consistent. Alternatively, the second fabric can be run at slower speeds than the first fabric, such as in a rush transfer process, in order to increase the bulk of the web or for some other purpose.

In accordance with the present invention, fabric 40 is a porous fabric. For instance, the fabric should have an air permeability of at least 400 cfm and particularly at least 500 cfm. For example, the fabric can have an air permeability of from about 500 cfm to about 800 cfm.

Further, the fabric should have a knuckle density of at least 100 knuckles per square centimeter. More particularly, the knuckle density can be from about 100 knuckles per square centimeter to about 500 knuckles per square centimeter. For instance, in one application, the fabric can have a knuckle density of from about 100 knuckles per square centimeter to about 300 knuckles per square centimeter.

Because a porous fabric is used in the process of the present invention, the fabric only contacts web 38 at selected locations when the web and the fabric are pressed together. For example, desirably fabric 40 only contacts less than 50% of the surface area of the side of the web that is placed into contact with the fabric when the fabric and web are pressed together. More particularly, for most applications, the fabric should only contact less than 30% of the surface area of the web, such as from about 25% to about 30% of the surface area of the web.

In general, fabric 40 can be made from any suitable material. For instance, the fabric can be made from metal wire or from polymeric filaments or yams.

From fabric 40, web 38 is then fed into a nip formed between a press roll 43 and a rotatable heated dryer drum 46, such as a Yankee dryer. In accordance with the present invention, web 38 is passed through the nip for a time and subjected to a temperature and pressure sufficient to form a steam front which passes from the surface of the dryer drum 46 through the web and out through the porous fabric 40. Through this process, a significant amount of the moisture contained in the web is expelled. Specifically, it has been discovered that at least 20% of the moisture contained in the web is expelled, particularly at least 40% of the moisture is expelled, and more particularly at least 50% of the moisture is expelled. Thus far, it has been discovered that from 20% to about 80% of the moisture is removed from the web during the process. Of course, the percentage of moisture that is expelled depends somewhat on the amount of moisture contained in the web prior to entering the nip.

The time the web remains in the nip and the temperature and pressure to which the web is subjected depend on various factors and the desired result. For most applications, however, the present inventors discovered that the web should remain in the nip for extended periods of time. For example, in most situations, the web should have a residence time in the nip of at least 10 milliseconds, particularly at least 15 milliseconds, and more particularly at least 20 milliseconds. It should be understood, however, that there are applications where longer residence times such as at least 30 milliseconds or at least 50 milliseconds may be required.

In order to increase the residence time of the web in the nip, any suitable press roll or heated drum can be used that is designed to form an extended nip. For example, in one embodiment, press roll 43 can be a deformable roll. Examples of press rolls suitable for use in the present invention include the Extended Nip Press marketed by Beloit, The Sue Press device marketed by Valment or The NIPCOFLEX Shoe Press marketed by Voith Sulzer. The deformable roll marketed by Voith Sulzer is a stationary shoe press system that includes a rotatable press sleeve that contacts the dryer drum surface. The press sleeve is supported on a rigid, stationary beam. The sleeve is pressed against an opposing surface by individual loading elements, using pressurized oil. Through this arrangement, longer nips can be formed for increasing the residence time of the web within the nip.

Similar to residence time, the temperature and pressure can also vary in the process. In general, the temperature of the heated dryer drum should be at least 212° F., particularly from about 220° F. to about 300° F. and more particularly from about 240° F. to about 300° F.

The pressure exerted on the web within the nip can range from about 100 pounds per square inch to about 800 pounds per square inch, and particularly from about 150 pounds per square inch to about 600 pounds per square inch. The pressure per linear inch can be from about 100 PLI to 1,000 PLI. It should be understood, however, that the pressure exerted on the web can be higher in localized areas, especially where the fabric knuckles are contacting the web.

The amount of moisture contained within the web 38 prior to entering the nip formed by press roll 43 and dryer drum 46 should be somewhat controlled. In particular, for most applications, the web should have a solids content of at least 10%. In general, the process of the present invention, can be used to dry any web containing moisture as long as the web has a solids content of greater than 10%. For most commercial applications, however, the web can have a solids content of from about 18% to about 50% when entering the nip. More particularly, the web can have a solids content of at least 28% prior to the nip.

In order to control the amount of moisture in the web, the system of the present invention can include a dewatering device 50. As shown in FIG. 1, dewatering device 50 is placed in contact with fabric 40 and is located upstream from press roll 43. The purpose of the watering device 50 is to remove some moisture from the web prior to being passed through the nip in order to optimize the drying process.

In general, any suitable dewatering device can be used in the process of the present invention. Examples of dewatering devices include, for instance, an air press, a wrap sealed air knife or a vacuum box. Alternatively, a capillary dewatering device can be incorporated into the system. Examples of capillary dewatering dewatering devices are disclosed in U.S. Pat. Nos. 5,598,643; 5,699,626; and 5,701,682 which are all incorporated herein by reference.

Once passed through the nip formed between the press roll and the dryer drum, web 38 is then transferred to the surface of dryer drum 46. If desired, web 38 can then be removed from the dryer drum by a creping blade 47. Creping web 38 as it is formed reduces internal bonding within the web and increases softness. Creping, however, is optional.

Through the process of the present invention, through air dried-like webs can be produced at lower energy requirements. The webs have high bulk and good softness characteristics. Further, the web is dried without significantly compressing the sheet. In fact, the porous fabric in contact with the web as it passes through the nip can, in some embodiments, form a pattern into the web. The pattern can increase the aesthetic appeal of the product. In some applications, it has also been discovered that some calendering effect has also been observed. Specifically, webs having a smooth surface have been produced.

The present invention may be better understood with reference to the following example.

EXAMPLE

The following example was performed in order to demonstrate the process of the present invention.

On a pilot system, a nip made in accordance with the present invention was constructed. The nip was formed between a press roll and a heated drum. Low basis weight tissue webs were passed through the nip at various operating conditions. The tissue webs were formed from a fiber furnish containing 50% eucalyptus fibers and 50% Northern softwood kraft fibers.

The speed of the web through the system varied between 40 feet per minute and 120 feet per minute. The webs tested had a basis weight range of from 10 pounds per ream to about 20 pounds per ream and varied in solids content from about 29% to about 41%. The temperature of the dryer drum ranged from 240° F. to 281° F. and the residence time of the web in the nip ranged from 10 milliseconds to 52 milliseconds. The pressure exerted on the web during the process was from about 400 psi to about 600 psi.

During the trials, the webs were placed on three different types of porous fabrics. The fabrics used were the LINDSAY 952 fabric, the LINDSAY 852 fabric, and the LINDSAY 342 fabric. These fabrics were made from polyester yarns and covered from about 25% to about 50% of the surface area of one side of the web. Specifically, the LINDSAY 952 fabric has an air permeability of 591 cfm, the LINDSAY 852 fabric has an air permeability of 678 cfm and the LINDSAY 342 fabric has an air permeability of 469 cfm.

The following results were obtained. It should be noted that in the following table, the amount of moisture in each web was calculated as amount of water in the web (grams) divided by the amount of fiber in the web (grams).

| Sample No. | Speed (fpm) | Basis Wt. (lb/ream) | Drum Temp. (° F.) | Time in nip (° F.) | Moisture in | Moisture out | Moisture removal (%) | Fabric Used |
|---|---|---|---|---|---|---|---|---|
| 1 | 40 | 20 | 275 | 52 | 1.4576 | 0.5774 | 60.39 | Lindsay 952 |
| 2 | 40 | 20 | 240 | 39 | 1.4783 | 0.5528 | 62.61 | Lindsay 952 |
| 3 | 40 | 20 | 265 | 27 | 1.7108 | 0.6753 | 60.53 | Lindsay 952 |
| 4 | 80 | 10 | 275 | 26 | 1.8241 | 0.3801 | 79.16 | Lindsay 952 |
| 5 | 80 | 10 | 255 | 26 | 1.7211 | 0.4712 | 72.62 | Lindsay 952 |
| 6 | 40 | 20 | 259 | 52 | 1.6681 | 0.8185 | 50.93 | Lindsay 852 |
| 7 | 40 | 20 | 265 | 39 | 1.6667 | 0.7479 | 55.13 | Lindsay 852 |
| 8 | 40 | 20 | 270 | 27 | 1.649 | 0.779 | 52.76 | Lindsay 852 |
| 10 | 80 | 10 | 281 | 26 | 2.2394 | 0.7889 | 64.77 | Lindsay 852 |
| 11 | 80 | 10 | 277 | 20 | 2.3036 | 0.769 | 66.62 | Lindsay 852 |
| 12 | 80 | 20 | 269 | 26 | 2.1417 | 1.3883 | 35.18 | Lindsay 852 |
| 13 | 80 | 20 | 260 | 20 | 2.126 | 1.5497 | 27.11 | Lindsay 852 |
| 14 | 40 | 20 | 272 | 54 | 1.7896 | 0.9732 | 45.62 | Lindsay 342 |
| 15 | 40 | 20 | 274 | 37 | 1.7593 | 0.9188 | 47.77 | Lindsay 342 |
| 16 | 80 | 10 | 270 | 22 | 2.1745 | 1.1909 | 45.23 | Lindsay 342 |
| 17 | 80 | 20 | 263 | 22 | 2.162 | 1.6102 | 25.52 | Lindsay 342 |
| 18 | 120 | 13.3 | 257 | 12 | 2.4437 | 1.8084 | 26.00 | Lindsay 342 |
| 19 | 120 | 13.3 | 257 | 15 | 2.4229 | 1.8219 | 24.80 | Lindsay 342 |
| 20 | 120 | 13.3 | 257 | 18 | 2.4246 | 1.7915 | 26.11 | Lindsay 342 |
| 21 | 80 | 20 | 260 | 27 | 2.1602 | 1.5279 | 29.27 | Lindsay 342 |
| 22 | 80 | 20 | 242 | 22 | 2.1614 | 1.5508 | 28.25 | Lindsay 342 |
| 23 | 80 | 20 | 250 | 12 | 2.1609 | 1.6572 | 23.31 | Lindsay 342 |
| 24 | 40 | 20 | 279 | 20 | 1.8112 | 1.0306 | 43.10 | Lindsay 952 |
| 25 | 80 | 20 | 286 | 10 | 1.8661 | 1.417 | 24.07 | Lindsay 952 |
| 26 | 80 | 20 | 269 | 10 | 2.0827 | 1.61 | 22.70 | Lindsay 952 |
| 27 | 80 | 20 | 263 | 10 | 2.0329 | 1.6206 | 20.28 | Lindsay 952 |
| 28 | 80 | 20 | 265 | 10 | 2.0956 | 1.676 | 20.02 | Lindsay 952 |
| 29 | 80 | 20 | 280 | 10 | 2.082 | 1.3619 | 34.59 | Lindsay 952 |
| 30 | 60 | 20 | 280 | 13.3 | 1.8088 | 1.0618 | 41.30 | Lindsay 952 |
| 31 | 60 | 20 | 276 | 13.3 | 1.7296 | 0.9952 | 42.46 | Lindsay 952 |
| 32 | 60 | 20 | 278 | 13.3 | 1.807 | 1.0333 | 42.82 | Lindsay 952 |

As shown above, 20% to 79% of the incoming sheet moisture was expelled during the test. These results indicate that drying efficiencies according to the present invention within the nip are 10 to 100 times higher than conventional drying procedures in which the web is pressed into engagement with the drum and then creped from the drum.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A process for producing tissue webs comprising the steps of:

forming a web from an aqueous suspension of fibers; and while having a solids content of at least 10%, passing said web on a porous fabric through a nip and onto a heated drum, said nip being formed between said heated drum and a press roll; wherein the air permeability of the porous fabric is at least 400 cfm, said web having a residence time in said nip of at least about 10 milliseconds and wherein said nip subjects said web to a temperature and pressure sufficient to expel at least 20% of the moisture contained in the web, said web having a basis weight of less than about 30 pounds per ream.

2. A process as defined in claim 1, wherein said porous fabric contacts one side of said web, said porous fabric covering less than 50% of the surface area of the side of the web when passed through the nip.

3. A process as defined in claim 1, wherein said web has a residence time of at least 20 milliseconds in said nip.

4. A process as defined in claim 1, wherein said web is subjected to a temperature of at least 212° F. in said nip.

5. A process as defined in claim 1, wherein said web is subjected to a temperature of from about 240° F. to about 300° F. within said nip.

6. A process as defined in claim 1, wherein said web is subjected to a pressure of from about 150 psi to about 600 psi in said nip.

7. A process as defined in claim 1, further comprising the step of passing said web through a dewatering device prior to passing said web through the nip.

8. A process as defined in claim 7, wherein said dewatering device comprises an air press.

9. A process as defined in claim 7, wherein said dewatering device comprises a capillary dewatering device.

10. A process as defined in claim 1, wherein said porous fabric has an air permeability of at least 500 cfm.

11. A process as defined in claim 1, wherein said porous fabric has a knuckle density of at least 100 knuckles per square centimeter.

12. A process for producing tissue webs comprising the steps of:

forming a web from an aqueous suspension of fibers, said aqueous suspension containing pulp fibers;

placing said web onto a porous fabric that has an air permability of at least 400 cfm;

passing said web through a dewatering device such that said web has a solids content of at least 10%; and thereafter passing said web through a nip while said web is on said porous fabric, said nip being formed between a press roll and a heated drum, said drum being heated to a temperature of at least 212° F., said web having a residence time within said nip of at least 10 milliseconds.

13. A process as defined in claim 12, wherein said porous fabric contacts one side of said web, said porous fabric contacting less than 50% of the surface area of the side of the web when passed through said nip.

14. A process as defined in claim 12, wherein said porous fabric contacts one side of said web, said porous fabric contacting less than 30% of the surface area of the side of the web when passed through said nip.

15. A process as defined in claim 12, wherein said dewatering device comprises an air press.

16. A process as defined in claim 12, wherein said dewatering device comprises a capillary dewatering device.

17. A process as defined in claim 12, wherein said drum is heated to a temperature of at least 220° F. and wherein said web is subjected to a pressure of from about 150 psi to about 600 psi when passing through said nip.

18. A process as defined in claim 12, wherein said web has a residence time of at least 20 milliseconds within said nip.

19. A process as defined in claim 12, wherein said web has a basis weight of from about 6 pounds per ream to about 30 pounds per ream.

20. A process as defined in claim 12, wherein passing said web through said nip causes at least 40% of any remaining moisture in the web to be expelled.

21. A process as defined in claim 12, wherein said press roll comprises a deformable roll.

22. A process as defined in claim 12, wherein said porous fabric has an air permeability of at least 500 cfm.

23. A process as defined in claim 22, wherein said porous fabric has a knuckle density of at least 100 knuckles per centimeter squared.

24. A process for producing tissue webs comprising the steps of:

forming a web from an aqueous suspension of fibers, said aqueous suspension containing pulp fibers;

placing said web onto a porous fabric, said porous fabric having a knuckle density of from about 100 knuckles per inch to about 500 knuckles per inch and said porous fabric having an air permability of at least 400 cfm; and passing said web through a nip and onto a heated drum, said nip being formed between said heated drum and a press roll, said drum being heated to a temperature of at least 212° F., said web being subjected to a temperature and a pressure within said nip sufficient to expel at least 20% of the moisture contained in said web, said web having a basis weight of less than about 30 pounds per ream.

25. A process as defined in claim 24, wherein said web has a residence time within said nip of at least about 10 milliseconds.

26. A process as defined in claim 24, further comprising the step of passing said web through a dewatering device prior to being passed through said nip.

27. A process as defined in claim 24, wherein said web has a solids content of at least 18% when passed through said nip.

28. A process as defined in claim 24, wherein said web has a solids content of at least 28% when passed through said nip.

29. A process as defined in claim 24, wherein said web has a residence time within said nip of at least 30 milliseconds.

30. A process as defined in claim 24, wherein said porous fabric contacts up to about 30% of the surface area of one side of said web when passed through said nip.

31. A process as defined in claim 24, wherein said web is subjected to a pressure of from about 150 psi to about 600 psi in said nip.

32. A process as defined in claim 24, wherein said press roll comprises a deformable roll.

33. A process as defined in claim 24, wherein said porous fabric has an air permability of at least 500 cfm.

* * * * *